US005725761A

United States Patent [19]

Phillips

[11] Patent Number: 5,725,761

[45] Date of Patent: Mar. 10, 1998

[54] MODULAR FILTER / CIRCULATION SYSTEM AND TRAVELING MAIN DRAIN FOR IN-GROUND SWIMMING POOLS

[76] Inventor: Harold L. Phillips, 602 S. Brady St., Claremore, Okla. 74017

[21] Appl. No.: 805,945

[22] Filed: Feb. 24, 1997

[51] Int. Cl.[6] ..... E04H 4/16

[52] U.S. Cl. ..... 210/169; 210/196; 210/206; 210/416.2; 15/17

[58] Field of Search ..... 210/169, 196, 210/198.1, 202, 206, 416.2; 15/1.7

[56] References Cited

U.S. PATENT DOCUMENTS

| | | | |
|---|---|---|---|
| 3,169,920 | 2/1965 | Payne | 210/169 |
| 3,570,017 | 3/1971 | Reece . | |
| 3,615,013 | 10/1971 | Reece . | |
| 3,688,908 | 9/1972 | Myers et al. . | |
| 3,694,263 | 9/1972 | Korn, Sr. . | |
| 3,716,883 | 2/1973 | Monroe . | |
| 3,809,116 | 5/1974 | Sanner . | |
| 3,820,173 | 6/1974 | Weller | 210/169 |
| 3,860,518 | 1/1975 | Henricksen . | |
| 3,886,616 | 6/1975 | Hayes . | |
| 3,928,202 | 12/1975 | Raubenheimer . | |
| 4,017,331 | 4/1977 | Thoelen, Sr. . | |
| 4,022,690 | 5/1977 | Smith . | |
| 4,100,641 | 7/1978 | Pansini . | |
| 4,105,557 | 8/1978 | Weatherholt . | |
| 4,154,680 | 5/1979 | Sommer . | |
| 4,187,654 | 2/1980 | Constantinescu . | |
| 4,193,143 | 3/1980 | DeCaryalho Vianna | 210/169 |
| 4,212,088 | 7/1980 | Goettl et al. . | |
| 4,304,022 | 12/1981 | Sommer . | |
| 4,584,733 | 4/1986 | Tietge et al. . | |
| 4,661,247 | 4/1987 | Weir et al. . | |
| 4,705,629 | 11/1987 | Weir et al. . | |
| 4,749,477 | 6/1988 | McGregor | 210/169 |
| 4,749,478 | 6/1988 | Brooks | 210/169 |
| 4,801,378 | 1/1989 | Desjoyauk et al. | 210/169 |
| 4,832,838 | 5/1989 | Stone . | |
| 4,835,809 | 6/1989 | Roumagnac | 15/1.7 |
| 5,099,535 | 3/1992 | Chauvier et al. | 15/1.7 |
| 5,338,446 | 8/1994 | Schuman et al. . | |
| 5,578,220 | 11/1996 | Becktold | 15/1.7 |

*Primary Examiner*—Peter A. Hruskoci
*Assistant Examiner*—Theodore M. Green
*Attorney, Agent, or Firm*—William S. Dorman; Dorman & Gilbert

[57] ABSTRACT

The present invention is directed generally toward a modular apparatus for the circulation, filtration, and chlorination of water in an in-ground swimming pool. In more particular, the invention disclosed herein relates to a modular and transportable pool-side unit in which the entire filtration and circulation systems, as well as the lighting and chlorination systems, for the pool are contained. Additionally, the instant invention utilizes a novel traveling main drain, wherein the functions of a conventional pool main drain and an automated pool sweeper are combined. The traveling main drain is moved about the bottom of the pool by the expulsion of water through a single horizontally mounted jet, said jet being free to rotate in a horizontal plane about the central axis of the device and thereby seek another movement direction when the device becomes blocked. The traveling main drain is connected to the modular pool apparatus through a novel hi-directional water conduit, which contains both a pressure and a vacuum water line.

11 Claims, 5 Drawing Sheets

MODULAR FILTER / CIRCULATION SYSTEM AND TRAVELING MAIN DRAIN FOR IN-GROUND SWIMMING POOLS

FIELD OF THE INVENTION

The present invention is directed generally toward a modular apparatus for the circulation, filtration, and chlorination of water in an in-ground swimming pool. In more particular, the invention disclosed herein relates to a modular and transportable pool-side unit in which the entire filtration and circulation systems, as well as the lighting and chlorination systems, for the pool are contained. Additionally, the instant invention utilizes a novel traveling main drain, wherein the functions of a conventional pool main drain and an automated pool sweeper are combined in a single water-driven unit.

BACKGROUND

The methodology utilized to build a typical in-ground swimming pool has not changed significantly in the last 50 years. Although the materials from which the pool is constructed have changed somewhat—with plastics being increasingly used to replace bronze, brass, and stainless steel—the basic in-ground pool layout, design, and construction approach have remained largely unchanged for most pools. Broadly speaking, today, as in the past, an in-ground swimming pool consists of the following elements: a water containment structure (the pool), a pump, a water filter, a water distribution network, an electrical network, and, optionally, a chlorinator and/or pool heater. In a typical arrangement, the pump and filter are located remotely from the pool itself, with the water distribution network providing pathways for moving water between the pump/filter and the pool. The electrical network supplies power, not only to the pump, but also to one or more lights that illuminate the pool at night and might be mounted, by way of example, in the pool wall below the water line.

Of particular importance to the present invention is the conventional practice of positioning of the pump and filter some distance away from the pool. This might be done for any number of reasons, but two commonly cited rationales involve aesthetics and safety concerns. Safety considerations include the obvious hazards associated with positioning electrical wiring and devices near water. Aesthetic concerns dictate that the pump, filter, chlorinator, and their labyrinth of interconnecting plastic pipes should be positioned away from the pool, perhaps behind a bush or some other landscaping feature, where they will be screened from view. In either case, the water distribution network and electrical network exist to make possible this remote placement of the pump and filter.

The water distribution system is typically a collection of plastic pipes that run underground and interconnect the pump, the swimming pool main drain, the water circulation jets, the skimmer, the filter, and (in some pools) a chlorinator and or pool heater. Broadly speaking the water discharge system consists of two sub-systems: a vacuum (or suction) sub-system and a discharge (or pressure) sub-system.

The water distribution system in an in-ground pool operates generally as follows. During normal operation, water is withdrawn from the pool through the skimmer—which collects (or skims) water from at or near the surface of the pool. Water passing through the skimmer is roughly filtered to remove the larger debris items before it enters the pipes that connect the skimmer to the pool pump. Additionally, water may also be simultaneously (or alternatively) withdrawn from the main drain, thereby extracting from the pool some of the sediment and heavier debris that tend to collect near the bottom of the pool. (The main drain is typically positioned at the lowest point of the pool and can be used to completely empty it of water if that is desired.)

The water drawn from the pool then is brought to the pool pump through suction piping where it thereafter passes through the pump and is then forced into the pool filter. The pool filter is designed to remove smaller particulate matter from the water and might consist of, by way of example, diatomaceous earth, sand, or alternatively a cartridge type filter media. After being forced through the filter, the cleaned and filtered water next passes through a chlorinator and/or pool heater before it is returned to the swimming pool via the discharge piping system. The filtered, chlorinated, and/or heated water then returns through the discharge piping to the swimming pool where it is typically released into the pool through one or more orifices formed in its side below the normal water level, thereby completing the cycle. The discharge orifices are positioned so as to create a continuous circulatory pattern of water in the pool, thereby tending to keep debris in suspension and mixing chlorinated water evenly throughout the pool.

The electrical network consists of a collection of buried wires that provide power to the pump and various light sources that might be placed around or within the pool. The electrical network powers the pump and various lights that might be distributed about the periphery pool, said lights being designed to illuminate the interior of the swimming pool at night. There is usually at least one underwater light in the "deep" end of the pool, although there may be others positioned above or below the water level of the pool. The location within the pool of the light or lights is typically not crucial, as reflected light tends to illuminate the entire pool.

Although the pool arrangement discussed above describes the arrangement in the vast majority of in-ground pools, there are a number of serious disadvantages that arise because of this particular design and, in more particular, because the pump and filter are located away from the pool itself. First, the electrical and water distribution networks are expensive to install because underground pathways for the networks must be created by digging down into the earth, on occasion with hand tools, to a depth of several feet—preferably at least to a depth that is below the frost line. The interconnecting (typically plastic) water pipes must then be securely sealed and joined together before laying them within these trenches, it being critical that there are no leaks or breaks in the pipes. Similarly, the runs of electrical lines to the swimming pool lights must also be buried, although in this instance the depth is not as critical. All of this adds time and expense to the pool construction project and may account for as much as 25% to 30% of the total cost of building a swimming pool.

A second disadvantage of the traditional pool construction arrangement is the energy loss that is occasioned by the long runs and bends in the piping between the pump and the pool. A typical distribution system has 30 to 40 feet of suction piping with assorted turns and fittings. The water discharge sub-system might consist of as many as 70 feet of piping, the additional length being necessary to distribute the water to the various water discharge orifices scattered around the periphery of the pool. It has been estimated that as much as 20% or 30% of the energy imparted to the water by the pump is lost to friction during that friction losses account loses for, resulting in a loss in water velocity at the discharge outlets. Thus, greater pump horsepower is used than would otherwise be required if the pump were positioned closer to the pool.

Third, the water and electrical networks are, on occasion, subject to mechanical failure and the conventional arrangement of buried water and electrical networks adds significantly to the expense of repairing a problem. Since these networks lay, for the most part, underground, when repair work is required a necessary first step is to locate and carefully dig up the portion of the network that is responsible for the problem. Only after the problem is exposed can it be diagnosed and repaired. Of course, even determining the location of the problem may itself be something of a challenge. This process of finding and digging up the problem portion of the network adds time and expense to what otherwise might be a relatively simple repair.

Fourth, maintaining the integrity of the conventional underground water distribution and electrical systems is a major concern of most pool owners. More precisely, in the winter it is often necessary to partially or completely drain the pool and fill the water distribution pipes with antifreeze to keep frozen water from expanding and damaging the network. This process is generally called "winterization" and can be a time consuming process. Obviously, this is potentially more of a problem in northern areas of the country, where hard freezes are routine, but most of this country is exposed to this problem to some degree. Additionally, winterization may also include evacuating water from the pool filter, pump, and chlorinator to keep them from bursting due to the expansion of frozen water contained therein.

Finally, the swimming pool wall is breached wherever an electrical light or water discharge orifice is placed. Each of these pool wall penetrations add expense to the construction of the pool, as the as the time required to properly form them and seal them against the water adds to the labor expense. Additionally, if the water seal around an opening fails or some other problem with it develops, it will be necessary to drain the pool to a level below that of the point of penetration in order to repair it.

In addition to the above cited problems that might arise with respect to the water and electrical distribution networks, a conventional swimming pool has two additional problems. First, proper pool maintenance calls for regular and thorough cleaning to keep the pool water clean and clear. An important part of the pool cleansing process involves the skimmer-pump-filter-discharge cycle. However, that system, by itself, is generally not enough to keep the pool free of debris, and it is customary to augment this process by manually sweeping the pool using a suction device that travels along the bottom and collects debris that have accumulated there. This is not an enormous burden on the pool owner, but it must be done regularly and cuts into time that the owner might otherwise enjoy swimming in the pool.

Finally, installing a main drain at the bottom of a conventional in-ground swimming pool creates some additional problems. In more particular, a main drain has a deserved reputation as a safety hazard. For example, it is well known that when the drain is in use under some circumstances an individual may be pulled by the suction downward against the drain and, if not freed promptly, caused to be drowned thereby. Also, in order to make the main drain a part of the water distribution network, connecting pipes must necessarily be run beneath the deepest part of the pool, once again creating potential problems if part of that water distribution system should fail.

Heretofore, as is well known in the swimming pool construction arts, there has been a need for an swimming modular filtration/circulation system that does not suffer from the above described problems. Further, the modular system should preferably eliminate the need for a conventional main drain, reduce the costs associated with construction and maintenance of the water and electrical distribution systems, and provide a ready means of winterizing the pool. Accordingly, it should now be recognized, as was recognized by the present inventor, that there exists, and has existed for some time, a very real need for a modular pool-side device that would address and solve the above-described problems.

Before proceeding to a description of the present invention, however, it should be noted and remembered that the description of the invention which follows, together with the accompanying drawings, should not be construed as limiting the invention to the examples (or preferred embodiments) shown and described. This is so because those skilled in the art to which the invention pertains will be able to devise other forms of this invention within the ambit of the appended claims.

SUMMARY OF THE INVENTION

The present invention relates generally to a novel modular filter/circulation system which is designed to be installed at pool side and combines in a single unit the skimmer, pump, filter, chlorinator, discharge outlets, and lights in a modular package, thereby eliminating most (if not all) of the network of water lines and electrical connections that are required for conventional pool equipment. Additionally, this system is specifically designed to be used in conjunction with a novel traveling main drain, thereby eliminating the piping that would otherwise be required to connect to a conventional main drain and reducing the risk of drowning.

By means of one aspect of the present invention there has been provided a modular system for filtering and circulating the water in a swimming pool in which the virtually entirety of the equipment required to perform said filtration and circulation is contained within a structure that is installed adjacent to the swimming pool. In more particular, the present invention combines a skimmer, an electrical pump, a filter, a chlorinator, one or more electrical lights, and a plurality of discharge orifices through which water is returned to the pool. In addition, the module is equipped with a "come-and-go" fitting that connects to a custom hose which in turn is connected to a remotely located traveling main drain.

Among the many advantages of the present invention are a reduction in the amount of energy required to circulate and filter pool water. This advantage is obtained by eliminating the water distribution network and the inefficiencies inherent therein. Because the present invention is installed at pool-side, there is no need for the extensive network of water pipes to convey the pool water to the pump. In more particular, since the pool skimmer is preferably incorporated as part of this device, water is drawn from the surface of the pool through the skimmer and then is passed directly to the pump which is proximate thereto, thereby reducing the extent of the water vacuum system dramatically. Additionally, in a presently preferred embodiment, the device—installed as it is as part of the pool wall—returns filtered water to the pool through a plurality of water discharge orifices which are incorporated into the pool-side wall of the device, thereby eliminating the need for the expansive pressure water distribution network which otherwise would be required to distribute the pressurized water to various orifices positioned about the periphery of the pool.

As a consequence of these advantages, a smaller pump may be utilized to drive this system than would otherwise be required, thereby saving money and energy.

Additionally, installation and use of the present invention will result in decreased construction costs because there is no need to dig and install the water and electrical distribution networks, thereby reducing installation time. In the presently preferred embodiment, the invention disclosed herein would be modular in nature and designed to be simply lowered as a unit into a receptacle formed adjacent to the pool wall that has been prepared to receive it. Further, the instant modular pool equipment system may be mass produced off-site and then delivered and rapidly installed as a complete unit at pool side. Through the use of the invention disclosed herein, pool wall penetrations for lights, discharge orifices, etc. can be eliminated, thereby shortening construction time as these same features need no longer be formed and sealed. Thus, all of the foregoing advantages contribute to a net reduction in construction effort and a concomitant savings dollar savings to the end consumer.

Finally, pool repair and maintenance costs will be decreased through the use of the instant invention as a consequence of the elimination of the conventional network of underground pipes and wiring. In terms of routine maintenance, installation of the present invention means that the pool may be winterized by simply lowering the water level in the pool and lifting the entire modular filter/circulation unit out of its receptacle: there is no need to drain the buried water lines and fill them with antifreeze—there are no buried water lines. Thus, the effort that must be directed toward winter maintenance is dramatically decreased. Further, the elimination of the network of buried water pipes which might otherwise leak and thereafter have to be dug up and repaired will eliminate one prominent source of repair problems for the pool.

According to a second aspect of the present invention, there is provided a traveling main drain which eliminates the need for a conventional pool drain and doubles as an automatic pool vacuum sweeper. In more particular, the instant inventor has developed a device that attaches to the modular system disclosed supra through a single orifice, said orifice delivering to the traveling main drain both pressure and vacuum water lines. The traveling main drain is a mobile device that rests on the bottom of the pool and is preferably mounted on spherical wheels, thereby permitting it to roll unimpeded in any direction. The drain is urged to move about the bottom of the pool through the expulsion of water under pressure, said pressurized water being supplied from the pool pump. The pressured water is preferably expelled through a restricted-diameter nozzle mounted on the device so as to create a jet-like propulsion effect. Similarly, the source of the vacuum water line is once again the pool pump. The traveling main drain preferably utilizes the vacuum line to provide a means for cleaning the bottom of the pool. In more particular, as the device is propelled across bottom of the pool by pressurized water, a semi-circular, for example, brush on its underside agitates lose lying debris on the bottom of the pool. These agitated debris are then urged up the vacuum line first to the pump and thereafter to the filter, where they are removed from the water before it is returned to the pool. Finally, use of this aspect of the present invention obviates the need for a conventional pool drain, as the vacuum line portion of the traveling pool drain may be used lower the water in the pool to any desired level—even to the point of completely emptying the pool if the devise is positioned at the deepest part of the pool.

Others have considered a modular design for pool-side equipment. For example, Weir, U.S. Pat. No. 4,661,247, ("Modular Operations Center for In-Ground Swimming Pool") teaches such a device. However, Weir is specifically designed to work with a conventional pool main drain, whereas the instant invention does not require a main drain—in fact, it preferably works without one. Additionally, Smith 4,022,690 ("Integral Pump Skimmer and Filter Unit for Above-Ground Swimming Pool") is a vertically arranged pump and filter for use with above-ground swimming pools and contains specific structure to customize it for use therewith.

In the discussion that follows, the language describes an application of the instant invention to a conventional in-ground swimming pool. But, it is understood by those skilled in the art that the invention herein described could be applied advantageously in other situations where equipment of this general type, being filtration and circulation equipment, are utilized.

DETAILED DESCRIPTION OF THE PREFERRED EMBODIMENTS

The instant invention pertains generally to a modular apparatus which contains the essential equipment necessary to filter, chlorinate, and circulate the water in a conventional swimming pool. In addition, the present invention is designed to preferably work in conjunction with a remote traveling main drain which obviates the need for a conventional main drain and provides additional functionality as an automatic pool cleaner.

Figure 8:
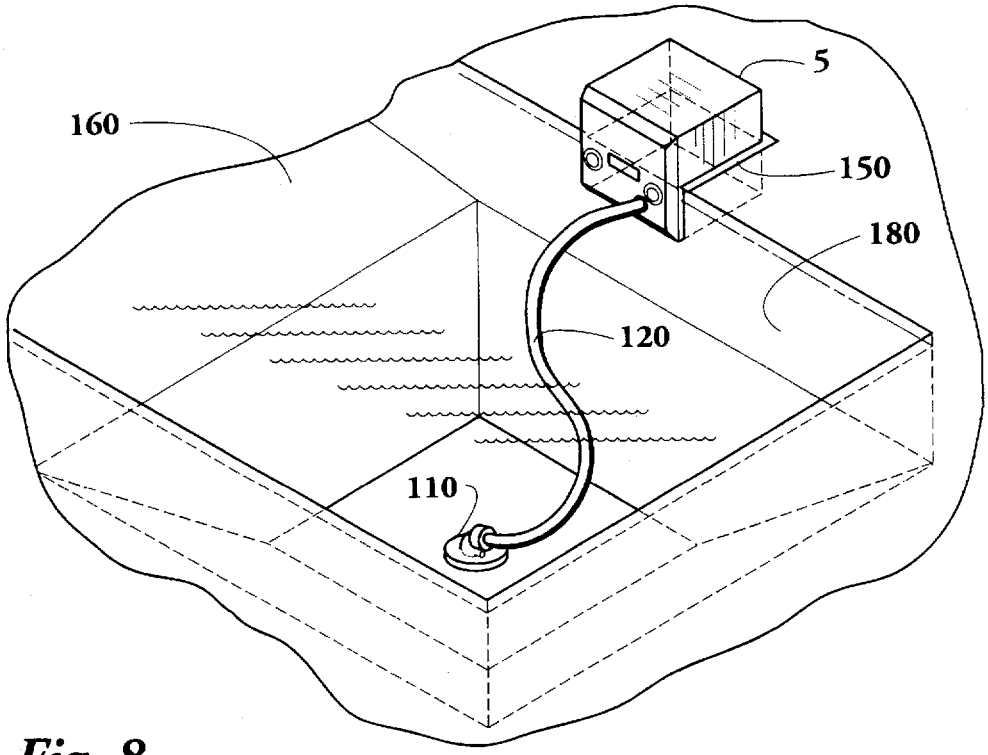
FIG. 8 is a schematic diagram that illustrates generally how the present invention is installed at the side of an in-ground swimming pool and how the traveling main drain relates thereto.

According to a presently preferred aspect of the present invention, there has been provided a device for circulating, filtering, and chlorinating swimming pool water in which all of the apparatus necessary to perform said tasks is contained within a single modular unit. As is most clearly illustrated in FIG. 8, the module 5 is encased within a housing and is preferably removably mounted within a generally box-shaped receptacle 150 adjacent to an in-ground swimming pool. The front face 170 of the invention is designed to be in direct contact with the water in the pool and effectively becomes part of the interior face of the swimming pool wall 180 after its installation. The receptacle 150 is preferably installed at a depth sufficient to place the skimmer 40 portion of the module 5 partially below the level of water in the pool 160. The module 5 can be mounted on either side of a swimming pool, but it is preferably located on the side of the pool that tends to be most often downwind during the summer months. The traveling main drain 110 is located remotely from the module 5 and is connected to said module 5 by a bi-directional conduit 120.

Figure 9:
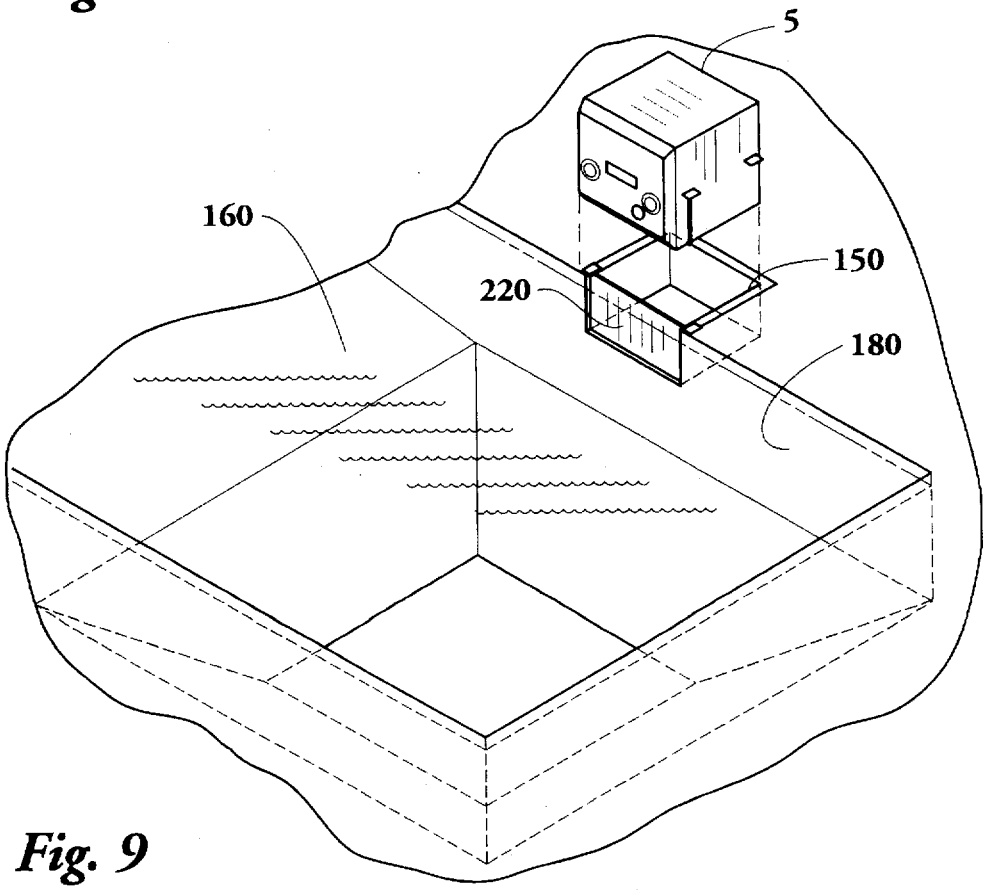
FIG. 9 is a schematic diagram that illustrates how the present invention is removed for winterization and replaced with a wall section insert.

As is best illustrated in FIG. 9, the instant modular system 5 is designed to be removed as a unit when it is necessary to winterize the pool 160. In more particular, the module 5 may be lifted out of its receptacle 150 and transported to a protected storage area for the winter. Additionally, after said module 5 is removed, a replacement wall panel 220 is preferably fastened across the pool side opening of said receptacle 150. Said wall panel 220 is designed to operate as follows. In the course winterizing the pool and removing said module 5 therefrom, it would be advantageous to begin by lowering the level of water in the pool 160. This would then allow water to be drained from the interior of the module 5, thereby reducing its weight it before it is lifted out of its receptacle 150. However, if the pool 160 is to be covered in winter, the level of the water therein should preferably be maintained at near operating levels. Thus, the wall panel 220 is designed to be bolted in place and operate as a water tight barrier between the receptacle 150 and the water in the pool, thereby keeping pool water from entering the interior of now-empty receptacle 150 and possibly damaging electrical or other components therein.

Figure 1:
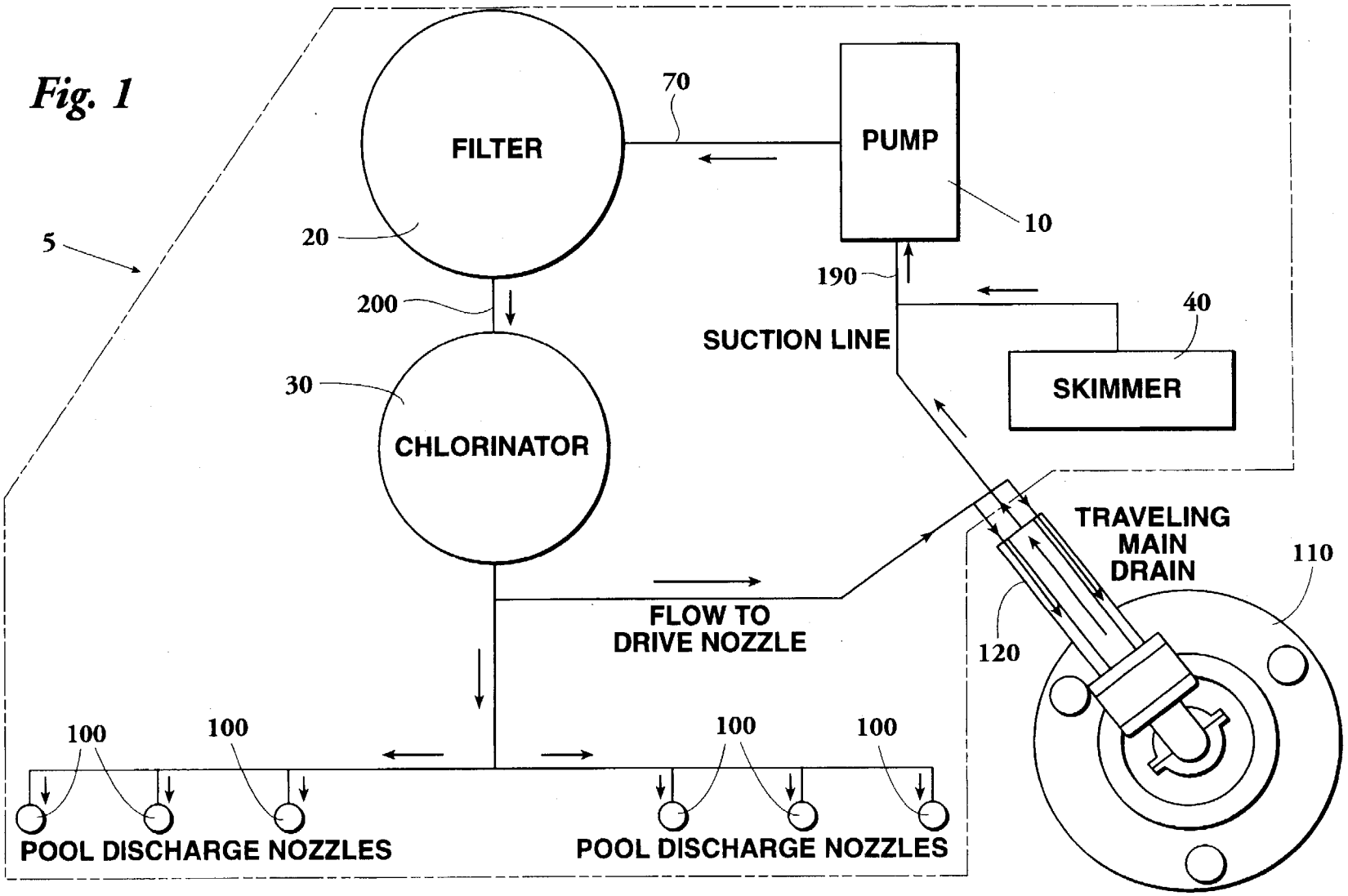
FIG. 1 is a schematic diagram that illustrates the principal features of a presently preferred embodiment of the instant invention.

Turning now to FIG. 1 wherein the instant invention is depicted generally, the presently preferred module 5 contains, at its heart, a standard electrical pool pump 10. When the pump 10 is running, it continually pulls water through vacuum inlet 190 into its interior, thereby creating a suction or vacuum within the vacuum inlet 190. Preferably, water drawn into the pump 10 through vacuum inlet 190 comes simultaneously from two sources: the skimmer 40 and bi-directional conduit 120 which terminates remotely at the traveling main drain 110. Water drawn through the pool skimmer 40 is taken from the surface of the water in the pool and is typically filtered through a coarse mesh filter to prevent the larger debris from entering the pump 10. In the instant invention, the pool skimmer 40 functions exactly as it would in a conventional swimming pool design. However, by situating the pool skimmer 40 within module 5, pool construction costs will be reduced and energy will be conserved, as shorter runs of pipe will be necessary to interconnect it with the pump 10. The skimmer 40 and the pump 10 are conventionally interconnected within module 5 by PVC pipe, although other materials might be equally suitable.

Water drawn from the remotely-situated traveling main drain 110 is conveyed to the module 5 through a bi-directional conduit 120 or hose, said bi-directional conduit 120 to be discussed in greater detail below. Water is drawn from the swimming pool via two sources—the skimmer 40 and the traveling main drain 120—and both sources are preferably merged inside the module 5 through the use of a "T" connector or similar connecting means, and thereafter are drawn into the pump 10.

Water under pressure departs pump 10 by way of pressure line 70 where it preferably next enters filter 20. Then, in a presently preferred embodiment, said water under pressure is subsequently intercepted within said filter 20 by deflector plate 210. Said filter 20 might be, by way of example only, a woven or non-woven fabric, diatomaceous earth coated onto a grid, or a bed of graded sand. Inside said filter 20, water entering from pressure line 70 is typically redirected downward by deflector plate 210, thereby forcing said water to pass through the filtering means of said filter 20 before it can exit the device. Note that the arrangement and function of deflector plate 210 depends on the particular choice of filter 20 and said deflector plate 210 is not required for some sorts of filters. That being said, the embodiment illustrated in the figures is a typical arrangement for a diatomaceous earth filter.

As the water passes over the filtering media, contaminating particular matter suspended in the pool water are removed. The filter 20 could be, by way of example only, a conventional swimming pool filter. However, the placement of the filter 20 within the module 5 results in shortened interconnecting water lines and a concomitant reduction in hydraulic friction, thereby producing a reduction in the amount of energy required to move the water from the pump 10 through the filter 20, whatever the choice of filter 20.

After passing through said filter 20, the filtered water leaves the filter by way of pressure line 200 where it is next preferably sanitized (or chlorinated) by chlorinator 30, although the inventors contemplate that some embodiments of the present invention may not include an automatic chlorinator. After the water is chlorinated it is then returned under pressure to the swimming pool by one of two routines: it is either expelled through pool discharge nozzles 100, or travels by way of bi-directional conduit 120 to the traveling main drain 110, where its release provides propulsion for the traveling main drain 110.

Figure 2:
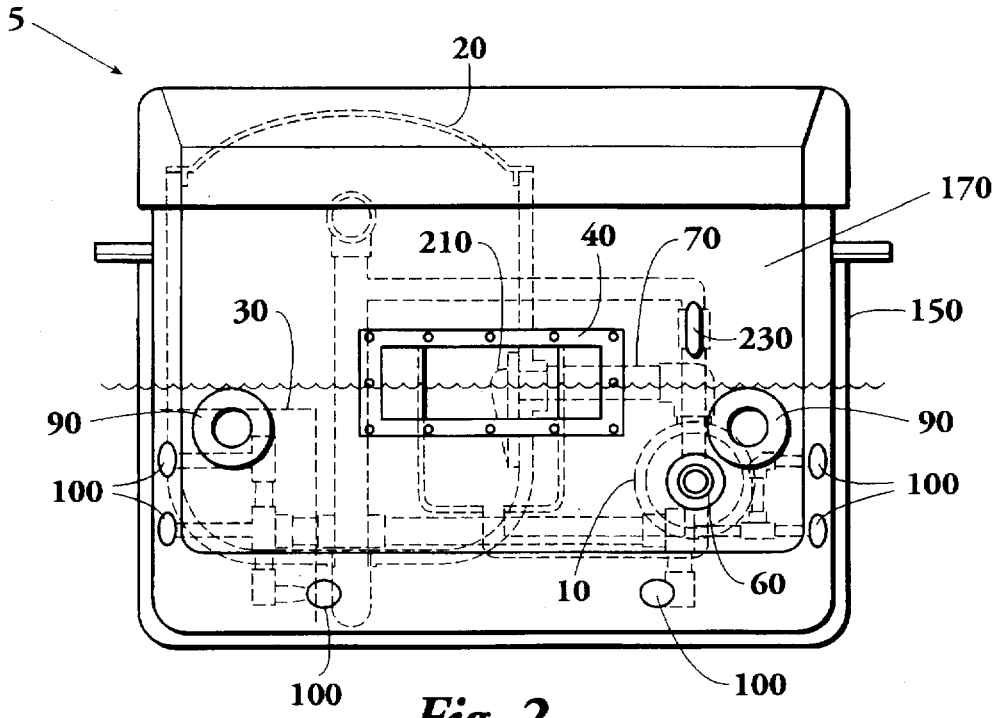
FIG. 2 displays a front elevation view of a presently preferred embodiment of the present invention.

In FIG. 2, the instant invention is illustrated in greater detail. As is depicted in this figure, the front face 170 of the module 5 contains an opening for the skimmer 40, through which water is drawn into the device when it is operating to circulate and filter pool water. Additionally on the front face 170 of the unit are a plurality of water discharge nozzles 100 through which filtered water is returned under pressure to the swimming pool.

Figure 3:
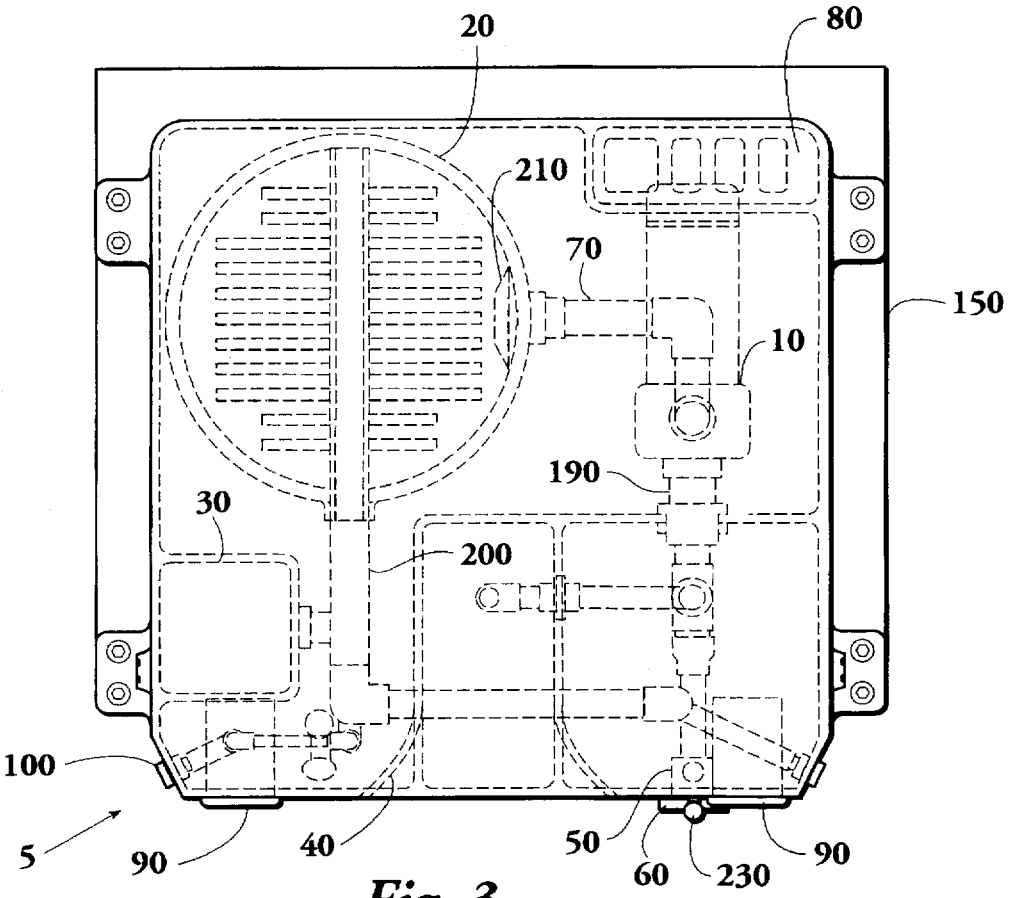
FIG. 3 contains a top plan view of the invention disclosed herein.
Figure 4:
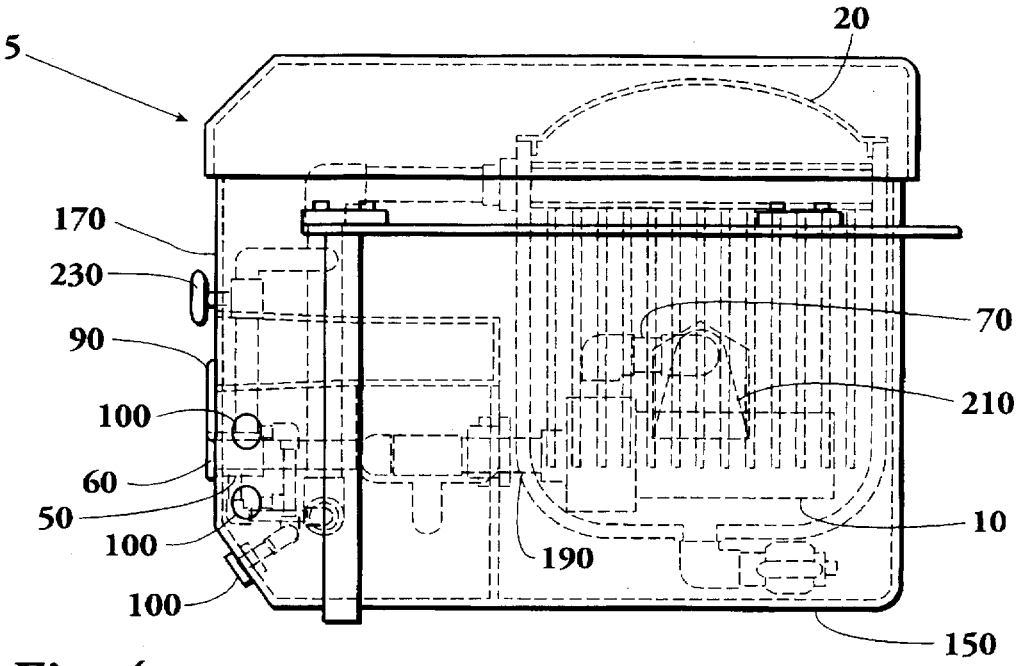
FIG. 4 illustrates a right side elevation of a presently preferred embodiment.

The water discharge nozzles 100 are disposed about the face 170 of the unit and oriented in such a way that they preferably impart a regular circulatory pattern to the water in the swimming pool. The purpose of encouraging the development of said circulatory pattern is twofold: first, to foster improved mixing of the expelled chlorinated water with the remainder of the water in the pool and, second, to keep the larger debris in suspension until they can be captured by the skimmer 40. More specifically, the presently preferred embodiment of the instant invention utilizes six discharge nozzles 100 oriented on face 170 as follows: two of said nozzles 100 discharge to the left, two of said nozzles 100 discharge to the right, and the remaining two nozzles 100 discharge downward at an angle in front of the module 5. This arrangement is best seen in FIGS. 3 and 4, wherein the orientation of the nozzles 100 can be viewed respectively from the top and side. The net result is to create a circulatory regime within the pool that moves water around the outside of the pool, along its bottom, back to the upper center of the pool, and toward the module 5 where it enters the module 5 through skimmer 40.

Returning to FIG. 2, a plurality of electrical lights 90 are preferably disposed about the front face 170 of the module 5 and are best positioned such that they lie below the normal level of water in the pool. The exact placement and orientation of these lights 90 is not critical, as reflections off of the walls of the pool and from the underside surface of the water will tend to disperse light throughout the entirety of the swimming pool at night. By placing the lights 90 within the front face 170 of module 5, the number of swimming pool wall penetrations that would otherwise be required are reduced. Additionally within the module 5, there has been provided an electrical box 80 which is best illustrated in FIG. 3. This electrical box 80 might contain, by way of example only, on-and-off switches for the electrical items within the module 5, a timer to control the pump and/or lights, and a ground fault interrupt circuit to protect those who are working on and around the module from electrical shock. Further, said electrical box 80 is designed according to a presently preferred embodiment so as to provide a single point electrical hookup for all of the equipment within said module 5.

In addition to the aforementioned items, the module 5 contains an internal junction 50, said internal junction 50 operating to bring together into a single component the filtered and/or chlorinated water from pressure line 200, and the water in the line that terminates at vacuum inlet 190. Located preferably on the front face 170 of said module 5 is a bi-directional coupling 60 (or, more descriptively, a "come-and-go fitting"), said bi-directional coupling 60 connecting internally to said internal junction 50 and conveying said vacuum and pressure water lines to the exterior of the module 5. Said bi-directional coupling 60 is designed so as to mate with the upper end of bi-directional conduit 120, thereby establishing both pressure and vacuum conditions within said conduit. The remote end of said bi-directional conduit 120 is attached to the traveling main drain 110. Finally, a ball valve 230 has been provided on the front face 170 to allow the pressure line to internal junction 50 to be closed, thereby obstructing the source of propulsion for the traveling main drain 110 and stopping its movement about the bottom of the pool. This ball valve 230 might be closed, by way of example, when swimmers are present in the pool, thereby assuring that the movement of the traveling main drain 110 along the bottom of the pool will not interfere with the swimmers.

Finally, it should be noted that, although the internal junction 50 and bi-directional coupling 60 have been described herein as consisting of two separate devices, in practice they could easily be easily combined into a single integrated coupling unit. The embodiment described above is the presently preferred configuration, though.

Figures 6, 7:
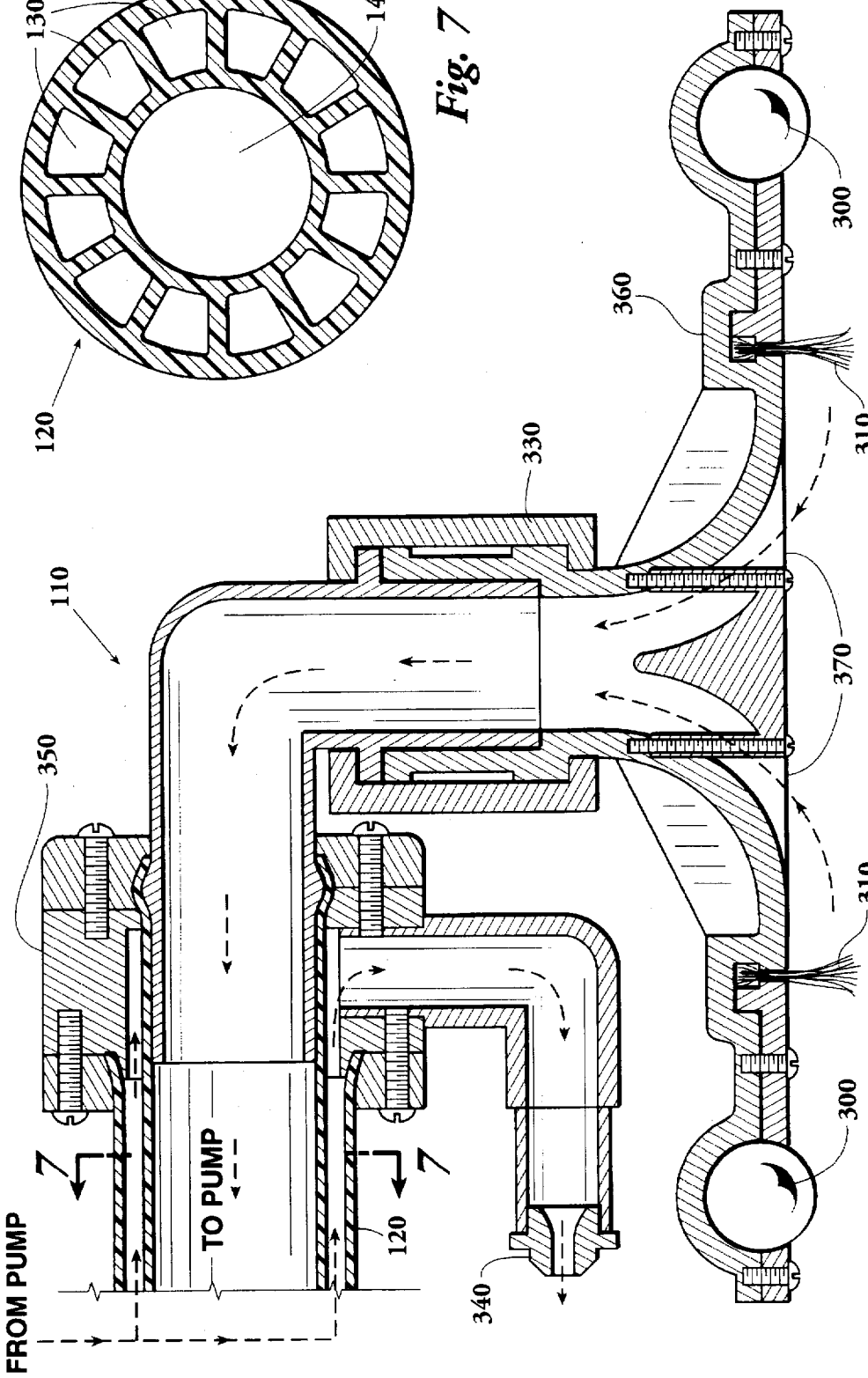
FIG. 6 contains a schematic cross sectional view of the traveling main drain.
FIG. 7 is a cross sectional view of a presently preferred embodiment of the bi-directional connecting conduit.

FIG. 7 contains a detailed view of a presently preferred embodiment of said bi-directional conduit 120. Central aperture 140 is preferably a vacuum water line which is in hydraulic contact with the intake of pump 10 and provides a conduit for the debris/water mixture from the bottom of the pool to travel back to module 5. Peripheral apertures 130 contain filtered and chlorinated water under pressure, which pressurized water is used to propel the traveling main drain 110 about the bottom of the pool. Note that the presently preferred arrangement is for the larger central aperture 140 to be the vacuum line. This is because water drawn through the central aperture 140 will contain debris from the bottom of the pool that could potentially clog the smaller peripheral apertures 130 if they were made to carry the vacuum component.

Although the presently preferred embodiment of said bi-directional conduit 120 is configured as illustrated in FIG. 7, other arrangements are certainly possible, including the use of two separate conventional hoses (one containing water under pressure and the other a vacuum line), said hoses preferably being bound together as a single unit. Finally, in the text that follows the bi-directional conduit 120 will be generally described as containing both a pressure line and a vacuum line, even though either line might, in fact, be composed of a plurality of individual compartments as is illustrated in FIG. 7.

Figure 5:
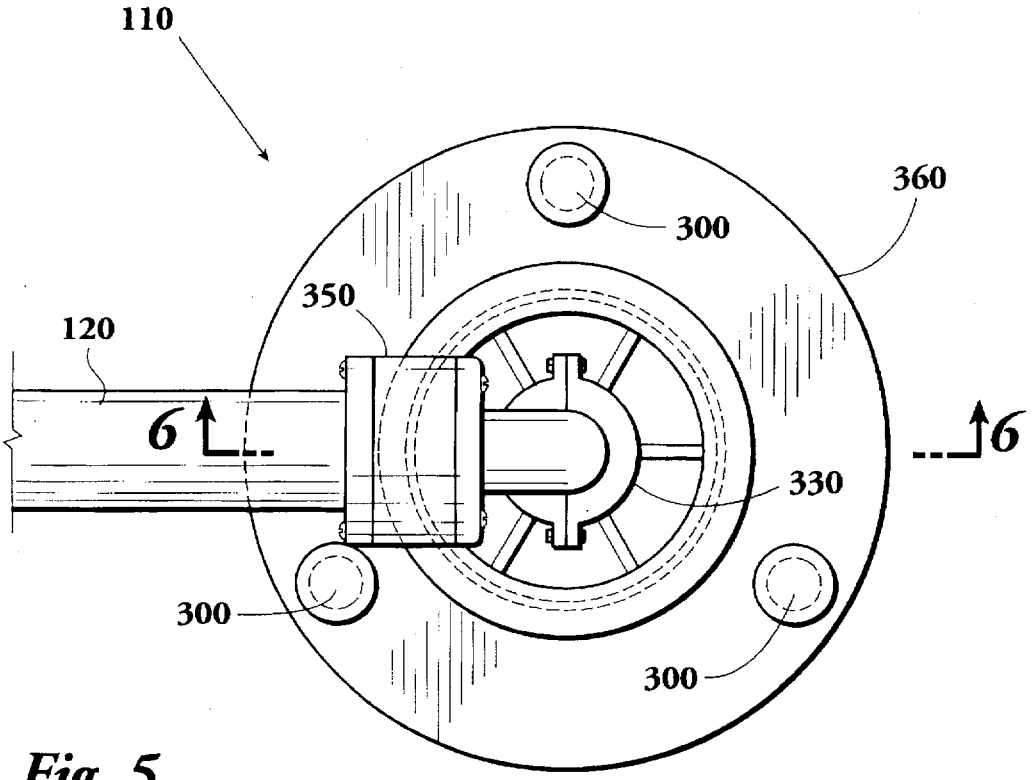
FIG. 5 is a top plan view of a presently preferred embodiment of the traveling main drain disclosed herein.

The traveling main drain 110 is illustrated generally in FIG. 5. The traveling main drain 110 is so called because it is designed to move freely about the bottom of the pool (travel) and it obviates the need for a traditional main drain. During normal operation, the traveling main drain 110 rolls along the bottom of the pool on spherical wheels 300, connected to the module 5 by bi-directional conduit 120. Said conduit 120 is preferably long enough to allow the traveling main drain 110 to reach every part of the pool bottom. Said traveling main drain 110 is connected to said bi-directional conduit 120 by a custom terminal junction 350. Finally, the orientation of the conduit 120 with respect to the base 360 of the traveling main drain 110 is allowed to vary through the use of a swivel joint 330.

Turning now to FIG. 6 wherein the features of the traveling main drain 110 are illustrated in greater detail, bi-directional conduit 120 preferably attaches directly to traveling main drain 110 through terminal junction 350. The function of terminal junction 350 is to separate the pressure and vacuum water components of said bi-directional conduit 120 and redirect each to its appropriate terminus. In more particular, water under pressure from the pump 10 that has traveled through bi-directional conduit 120 is directed downward and out through drive jet nozzle 340. Drive jet nozzle 340 is constricted at its terminus, thereby creating a jet propulsion effect which tends to push the traveling main drain 110 along the bottom of the pool in a direction opposite to the current orientation of the drive jet nozzle 340. The stream of pressurized water pushes the traveling main drain 110 in a somewhat random pattern around the bottom of the pool. The use of swivel joint 330 prevents said drain 110 from getting stuck in a corner. When the traveling main drain 110 encounters an obstacle, the drive jet nozzle 340 will tend to rotate horizontally about swivel joint 330, thereby pushing said traveling main drain 110 in another direction. Finally, the present inventor contemplates that on some occasions it might become desirable to stop the motion of the traveling main drain 110. As has been discussed previously, in the presently preferred embodiment of the instant invention, a ball valve 230 has been provided on the front face 170 of module 5 which can be used to close the pressure line to the traveling main drain 110, thereby causing its motion to cease. The ball value 230 is best illustrated in FIGS. 2 and 4.

Similarly, terminal junction 350 isolates the vacuum component of bi-directional conduit 120 and exposes it to the swimming pool floor, allowing the traveling main drain 110 to preferably function as an automatic pool sweeper. In more particular, on the underside of said traveling main drain 110 is a circular brush 310 which is in continuous contact with the bottom of the pool. As the traveling main drain 110 moves about, said brush 310 sweeps along the bottom of the pool and causes debris that are lying there to be loosened and placed (at least briefly) in suspension. These suspended debris are then drawn into a vacuum aperture 370 on the underside of the traveling main drain 110, through the vacuum member of terminal junction 350, and into the vacuum component of bi-directional conduit 120, where said suspended debris are ultimately conveyed along with water from the pool floor to the pump 10.

While the inventive device has been described and illustrated herein by reference to certain preferred embodiments in relation to the drawings attached hereto, various changes and further modifications, apart from those shown or suggested herein, may be made therein by those skilled in the art, without departing from the spirit of the inventive concept, the scope of which is to be determined by the following claims.

What is claimed is:

1. A modular water filtration and circulation system for use in a swimming pool containing water, said swimming pool having a bottom, sides, and upper side edges, said system containing the circulatory, filtration, and piping requirements for said swimming pool, comprising:

(a) a modular housing mounted adjacent to an upper side edge of said pool and communicating with a surface of the water in the pool when the pool is filled;

(b) a skimming aperture in said modular housing through which water is skimmed from the surface of the water in the swimming pool;

(c) pump means within said modular housing, said pump means having an input vacuum side and an output pressure side;

(d) a filter within said modular housing for filtering liquids by passing them therethrough, said filter having (1) an intake port for supplying water to said filter and communicating with said output pressure side of said pump, and (2) an outlet port for carrying filtered water away from said filter;

(e) a bi-directional coupling mounted on said housing and enclosing a pressure member communicating with the outlet port of said filter and a vacuum member communicating with the input vacuum side of said pump, (1) said vacuum member drawing water from said swimming pool and not being connected to a swimming pool main drain, and, (2) said pressure member returning filtered water to said swimming pool; and, (f) a plurality of pool discharge nozzles mounted on said housing and communicating with said filter outlet, said pool discharge nozzles returning filtered water to said swimming pool.

2. A swimming pool water filtration and circulation system according to claim 1 wherein said system additionally contains an automatic pool chlorinator within said housing for sanitizing water, said pool chlorinator communicating with the output pressure side of said pump.

3. A swimming pool water filtration and circulation system according to claim 1 wherein said module additionally contains at least one electrical light mounted on said housing.

4. A swimming pool water filtration and circulation system according to claim 1 wherein said discharge nozzles are oriented so as to impart a regular circulatory pattern to the water in the swimming pool.

5. A swimming pool water filtration and circulation system according to claim 1, further comprising:

(g) a water propelled traveling main drain for cleaning the bottom of the swimming pool, said traveling main drain having (1) a wheel supported body, said body having an upper surface, a lower surface proximate to said swimming pool bottom, and a vacuum aperture passing therethrough for the taking of water from the bottom of the swimming pool, (2) a vertical duct having an upper end and a lower end, said lower end communicating with said vacuum aperture, (3) a junction mounted proximate to said upper end of said vertical duct, said junction containing a pressure compartment and a vacuum compartment, said vacuum compartment in communication with said upper end of said vertical duct, (4) a horizontally directed jet drive nozzle for propelling said traveling main drain about the bottom of the swimming pool by force of the water expelled therefrom, said jet drive nozzle (A) having an inlet and an outlet, said inlet communicating with said pressure compartment of said junction and said outlet having a restricted terminus to increase the motive force produced by the water passing therethrough, (B) being rotatably mounted on said vertical duct and rotating freely in a horizontal plane thereabout, said outlet terminus being oriented to point radially away from said vertical duct, and, (C) urging said traveling main drain to move in a direction away from the orientation of said outlet terminus by expelling water therefrom;

(h) an external pressure line having an upper end and a lower end, said upper end of said external pressure line communicating with said pressure member of said coupling and said lower end communicating with said pressure compartment of said junction; and, (i) an external vacuum line having an upper end and a lower end, said upper end of said external vacuum line communicating with said vacuum member of said coupling and said lower end communicating with said vacuum compartment of said junction.

6. A swimming pool water filtration and circulation system according to claim 5 further comprising a bi-directional conduit, said bi-directional conduit enclosing said external vacuum and said external pressure line.

7. A swimming pool water filtration and circulation system according to claim 6 wherein said bi-directional conduit comprises:

(1) a cylindrical outer surface;

(2) a cylindrical inner vacuum line, said cylindrical inner vacuum line being co-axial with said cylindrical outer surface; and, (3) a plurality of equally spaced peripheral pressure lines, said peripheral pressure lines formed between said cylindrical inner vacuum line and said cylindrical outer surface.

8. A swimming pool water filtration and circulation system according to claim 6, wherein said traveling main drain further comprises:

(5) at least one brush on the lower surface of said traveling main drain, said brush sweeping against said bottom of said swimming pool as said traveling main drain moves thereabout.

9. A water propelled traveling main drain for use with a source of pressurized water and a vacuum source, said traveling main drain being adapted to travel about a bottom of a swimming pool collecting debris therefrom, comprising:

(a) a wheel supported body, said body having an upper surface, a lower surface proximate to said pool bottom, and a body aperture passing therethrough for the taking of water from the bottom of the pool;

(b) a vertical duct having an upper end and a lower end, said lower end communicating with said body aperture;

(c) a junction mounted proximate to said upper end of said vertical duct, said junction containing a pressure compartment and a vacuum compartment, (1) said vacuum compartment in communication with said vacuum source and said upper end of said vertical duct, and, (2) said pressure compartment in communication with said source of pressurized water;

(d) a horizontally directed jet drive nozzle for propelling said traveling main drain about the bottom of the swimming pool by force of the water expelled therefrom, said jet drive nozzle (1) having an inlet and an outlet, said inlet communicating with said pressure compartment of said junction and said outlet having a restricted terminus to increase the motive force produced by the water passing therethrough, (2) being rotatably mounted on said vertical duct and rotating freely in a horizontal plane thereabout, said outlet terminus being oriented to point radially away from said vertical duct, and, (3) urging said traveling main drain to move in a direction away from the orientation of said outlet terminus by expelling water therefrom.

10. A traveling main drain according to claim 9 wherein said traveling main drain is removably connected to said source of pressurized water and said vacuum source.

11. A traveling main drain according to claim 9 further comprising:

(e) at least one brush on the lower surface of said traveling main drain, said brush sweeping against said bottom of said swimming pool as said traveling main drain moves thereabout.

* * * * *